United States Patent [19]

Street

[11] Patent Number: 4,694,580

[45] Date of Patent: Sep. 22, 1987

[54] MACHINE FOR GUIDING AND MARKING PLYSTOCK

[75] Inventor: Robert W. Street, Kent, Ohio

[73] Assignee: General Tire, Inc., Akron, Ohio

[21] Appl. No.: 888,679

[22] Filed: Jul. 24, 1986

[51] Int. Cl.[4] ..... B43L 13/00; B65H 25/26

[52] U.S. Cl. ..... 33/32.6; 226/19

[58] Field of Search ..... 33/32.5, 32.6, 32.7; 226/19, 20

[56] References Cited

U.S. PATENT DOCUMENTS

| | | | |
|---|---|---|---|
| 2,078,386 | 4/1937 | Kendis | 33/32.6 |
| 2,566,399 | 9/1951 | Bishop | 226/20 |
| 3,150,432 | 9/1964 | McCreary | 226/19 |
| 3,170,829 | 2/1965 | Batten | 226/19 |
| 3,225,988 | 12/1965 | Drenning | 226/19 |
| 3,490,674 | 1/1970 | Ott, Jr. et al. | 226/19 |
| 4,384,686 | 5/1983 | Wiley et al. | 226/20 |

FOREIGN PATENT DOCUMENTS

| | | | |
|---|---|---|---|
| 6275 | 1/1979 | Japan | 226/20 |

*Primary Examiner*—Richard R. Stearns

[57] ABSTRACT

A tire building machine for marking the centerline of a continuous piece of plystock is described as having, (I) a carriage which is movable along a trackway which is normal to the direction of travel of the piece of plystock being marked, (II) a pair of sensors carried by the carriage for monitoring the opposing marginal edges of the piece of plystock, (III) a device centrally disposed on the carriage between the sensors for marking the centerline of the plystock, (IV) a mechanism for adjusting the spacing between the sensors when the width of the plystock varies, and (V) a mechanism for moving the carriage and attached sensors, in unison, along the trackway, when the piece of plystock wanders from the pathway which the sensors are initially set to monitor. Also disclosed, is a mechanism for covering each of the marginal edges of the piece of plystock with a pair of unvulcanized rubbery gum strips, and a mechanism for monitoring movement of the strips into contact with the piece of material and adjusting such movement when required.

7 Claims, 3 Drawing Figures

MACHINE FOR GUIDING AND MARKING PLYSTOCK

BACKGROUND OF THE INVENTION

The invention relates to tire building machinery, especially machines that are used in guiding a piece of plystock along a pathway and marking the centerline of the plystock as it moves along the pathway.

At present, two stationay guides are used in conjunction with a scriber that is positioned midway between the guides just downstream from the guides to prevent the scriber from cutting through the plystock. Theoretically this should work, but, practically speaking it doesn't, since the width of the plystock varies and the plystock wanders laterally, so that the mark of the scriber may be off center as much as one inch. The invention is designed to provide a machine which will adapt to the wanderings of the plystock and variance in the width of the plystock to maintain the making of the plystock at its centerline midway between the opposing marginal edges of the plystock.

SUMMARY OF INVENTION

Briefly stated, the invention is in a machine for guiding and marking plystock as it travels along a desired pathway. The machine essentially comprises, (a) a stationary frame, (b) a support carriage which is mounted on the frame for limited reciprocating movement transversely of the direction in which the plystock travels across the carriage, (c) pair of sensors mounted on the carriage in spaced relation, (d) means for simultaneously moving the sensors and carriage when the plystock wanders laterally from the desired pathway, (e) means for moving the sensors, in unison, independently of the carriage when the width of the plystock varies, and (f) means on the carriage for placing a mark on the plystock midway between opposing marginal edges of the plystock when the plystock travels past the sensors.

Another facet of the invention are means for placing a pair of gum strips in predetermined overlapped relation on each of the marginal edges of the plystock to cover any exosed ends of tire cords that are used to reinforce the plystock.

DESCRIPTION OF DRAWING

The following description of the invention will be better understood by having reference to the accompanying drawing, wherein.

DETAILED DESCRIPTION OF INVENTION

Figure 1:
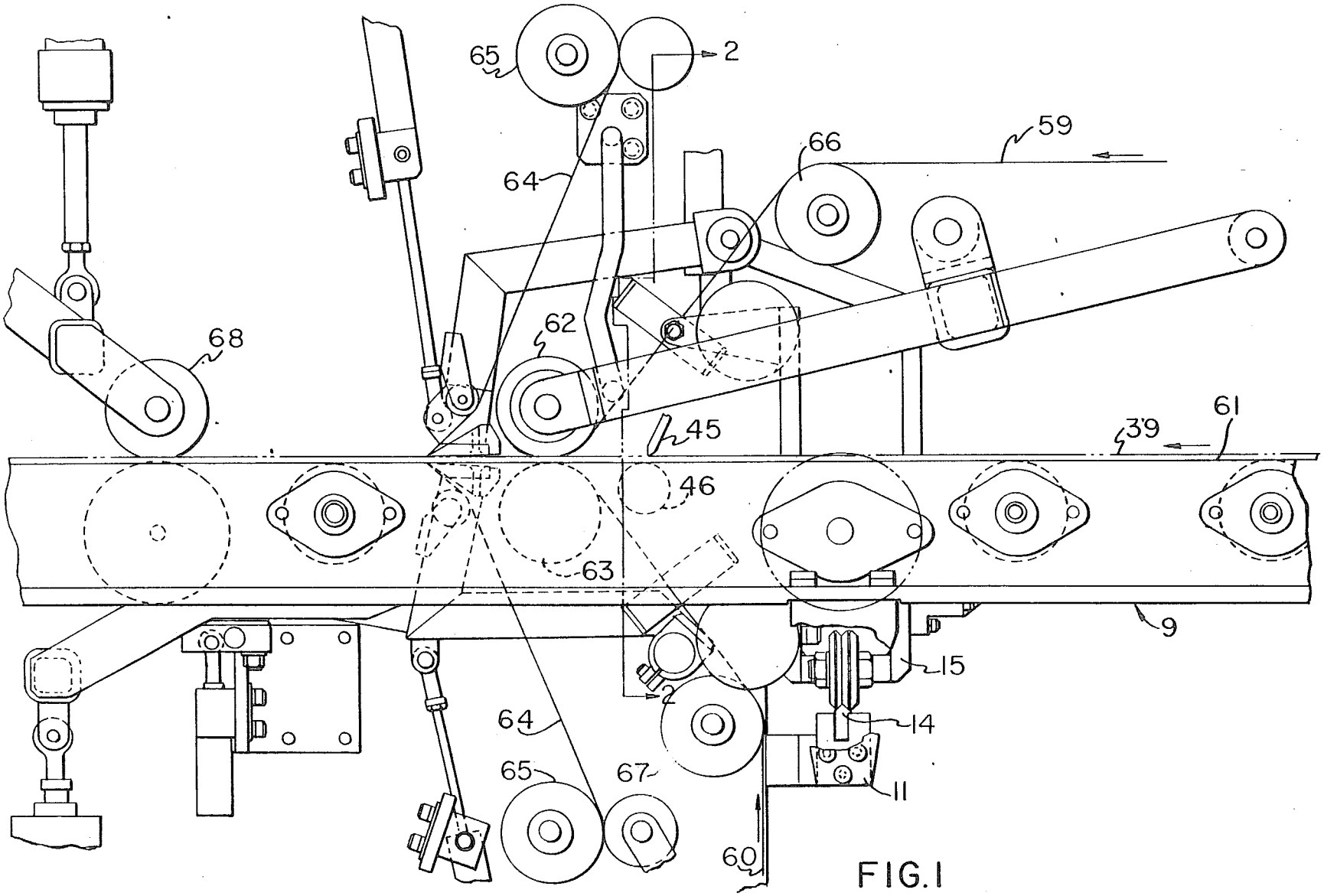
FIG. 1 is an enlarged side view of a portion of a machine which is made in accordance with the invention, parts of the machine being removed to show a device for applying gum strips to marginal edges of a piece of plystock as it travels through the machine.
Figure 2:
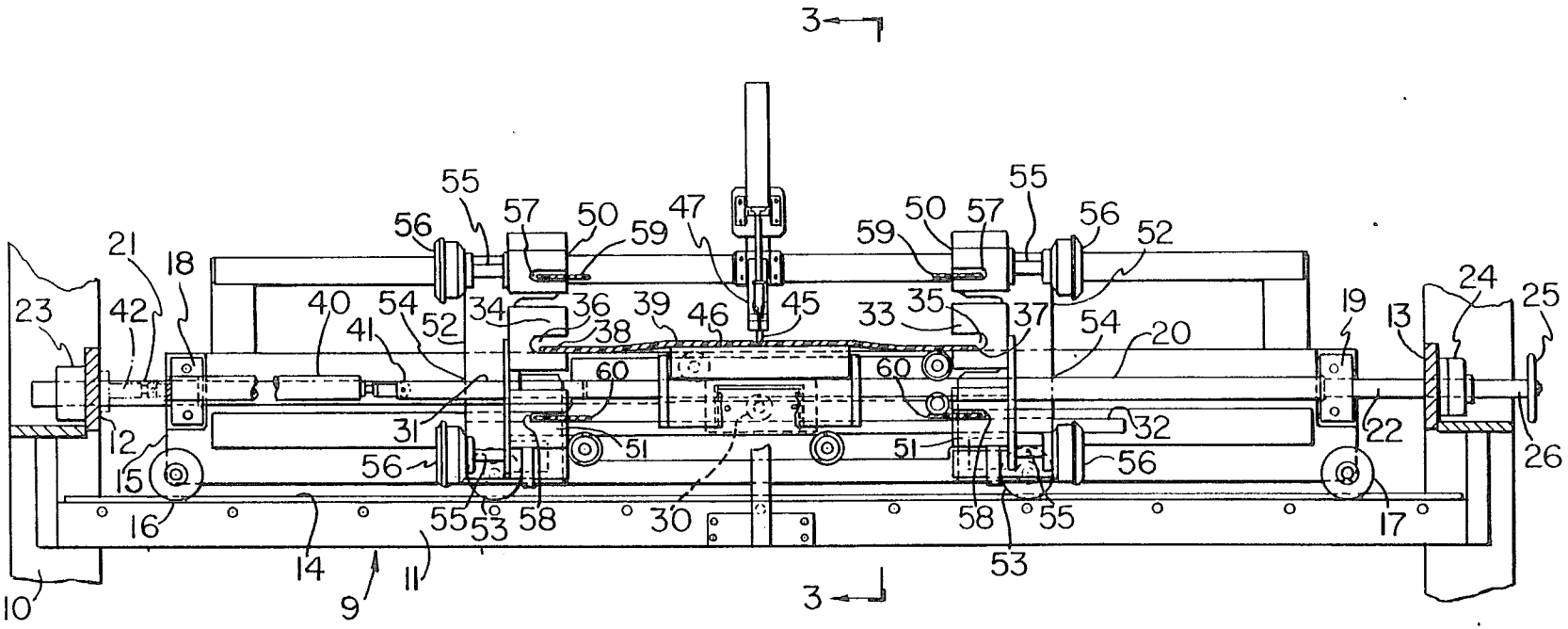
FIG. 2 is a section of the machine viewed from the plane 2—2 of FIG. 1.

With general reference to the drawing for like parts and specific reference to FIGS. 1 and 2, there is shown a machine 9 which includes a stationery frame 10 that is designed to rest on a horizontal factory floor. The frame 10 has a horizontal base 11 with opposing vertically upstanding ends 12, 13. A single track 14 is horizontally mounted on the base 11 of the frame 10 between the upstanding ends 12, 13.

A carriage 15 has a pair of freely rotatable wheels 16, 17 which are designed to rollingly engage the track 14. The carriage 15 has a pair of horizontally aligned bushings 18, 19 which are mounted at opposing ends of the carriage just above the wheels 16. 17. A threaded drive screw 20 is horizontally mounted for rotation in the bushings 18, 19, and has a pair of axially aligned unthreaded extensions 21, 22 which slidably extend through a pair of bearings 23, 24 that are secured to the upstanding ends 12, 13 of the frame 10, to stabilize the carriage 15 in an upright position as it moves along the track 14. Thus, the drive screw 20 is mounted to rotate independently of the carriage 15 while moving in unison, with the carriage 15 along the track 14. A knob 25 is provided at the far distal end 26 of the drive screw extension 22 to manually rotate the drive screw 20.

A toothed, main pinion gear 30 is centrally mounted on the carriage 15 midway between the bushings 18, 19 for rotation about an axis which is normal to the track 14. The main pinion gear 30 is sandwiched between, and in meshing relation with, a pair of upper and lower toothed racks 31, 32 which are restrained by a number of strategically located support rolls for reciprocation in horizontal planes in response to rotation of the main pinion gear 30 which causes the racks 31, 32 to move at the same rate and time in opposite directions.

A pair of sensors 33, 34 are carried by the racks 31, 32 and likewise move simultaneously towards and away from each other to vary the spacing between them. The sensors 33, 34 having confronting, horizontally aligned slots 35, 36 in which the opposing marginal edges 37, 38 of a piece of plystock 39 are placed and monitored for lateral movement. A hydraulic cylinder 40 is coupled between the carriage 15 and adjacent free distal end 41 of the upper rack 31 for simultaneously reciprocating the upper and lower racks 31, 32 in response to a signal from one of the sensors 34 which is in electrical communication with the hydraulic cylinder 40. The other sensor 33 is in electrical communication with a second hydraulic cylinder 42 which is coupled between the frame 10 and carriage 15 for moving the carriage and attached sensors 33, 34 in unison. It can be appreciated that the sensors 33, 34 and hydraulic cylinders 40, 42 coact to maintain the carriage 15 centrally below the plystock 39 should it wander laterally from the desired path of travel, or should the width of the plystock vary from a norm to which the sensors 33, 34 are initially adjusted to accommodate. The rack and pinion mechanism could be replaced by a system of pulleys and cables, although the latter is believed to be less reliable and require more inspection and maintenance to insure operability.

Figure 3:
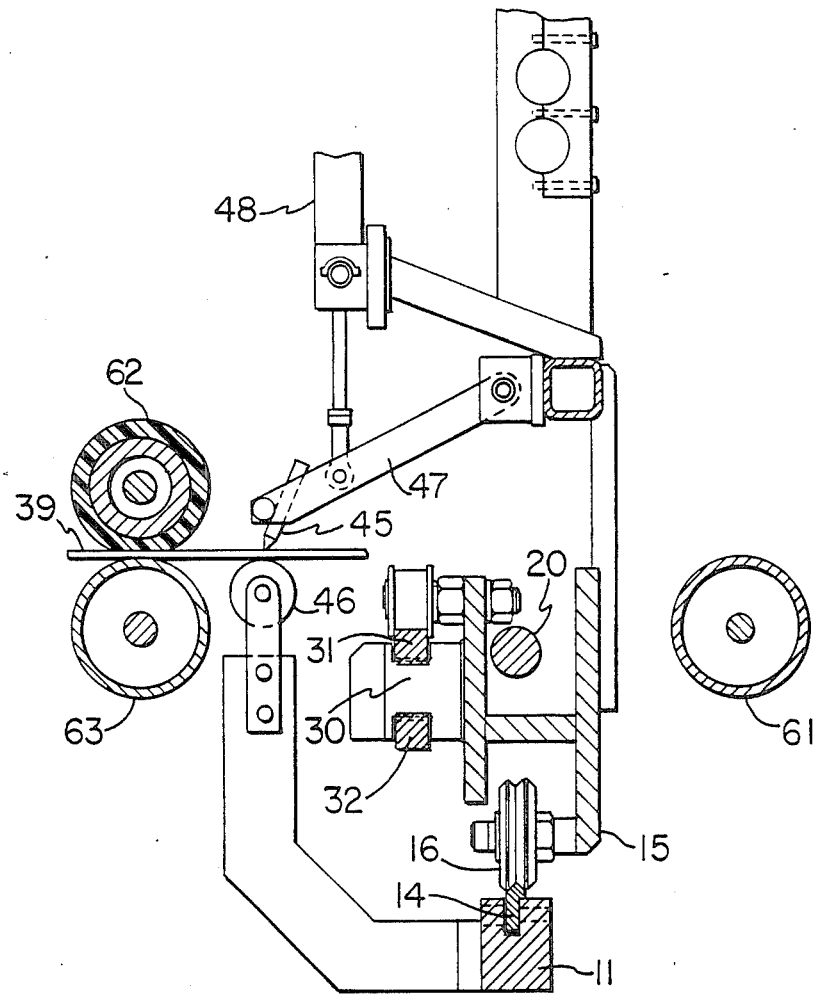
FIG. 3 is a section of the machine viewed from the plane 3—3 of FIG. 2.

A scriber in the form of a metal stylus 45, is centrally mounted on the carriage 15 vertically above the main pinion gear 30 and plane to travel of the plystock 39. Directly below the scriber 45 is a support roll 46 which is mounted on the carriage 15 for rotating freely about an axis which is normal to the direction of travel of the plystock 39. The scriber 45 is clamped to a lever arm 47 (FIG. 3) which is pivotally mounted on the carriage 15. A pneumatic cylinder 48 is coupled between the carriage 15 and lever arm 47 between opposing ends thereof, to rotate the lever arm 47 and attached scriber 45 to and from the support roll 46 to mark the center of the plystock as it travels over the support roll 46 between the sensors 33, 34. In some cases, the scriber 45 could be in the form of a paint applicator for painting a centerline on the plystock 39.

The foregoing describes the basic machine 9 which is used in combination with a scribing device for marking the centerline of a piece of unvulcanized rubbery material. This particular machine is designed for use with the carcass ply of a radial-type truck tire. Such carcass plies have radially oriented metal reinforcement cards which have exposed, cut ends at the marginal edges of the plystock. This machine 9 has the capability of applying two unvulcanized gum strips to each of the marginal edges of the plystock to cover and encapsulate the sharp, cut ends of the metal cords in rubber.

A pair of strip sensors 50, 51 are disposed in substantially vertically aligned relation above and below each of the plystock sensors 33, 34. The two pairs of strip sensors 50, 51 are carried by similar carts or trolleys 52 adjacent the marginal edges 37, 38 of the plystock 39. Each of the trolleys 52 is mounted on a single wheel 53 which rolls on the track 14. Each trolley 52 has a threaded bore 54 for meshing engagement with the threaded drive screw 20 which extends through the bore 54. Thus, the two confronting trolleys 52 will move towards and away from each other depending on the direction in which the drive screw 20 is rotated by means of the knob 25. The lateral positions of the strip sensors 50, 51 on the trolleys 52 can be finely adjusted by means of an adjusting screw 55 and knob 56 which are fastened between the trolleys 52 and each of the strip sensors 50, 51 which are provided with horizontal slots 57, 58 for receiving gum or flare strips 59, 60 which are applied in abutting and overlapping relation on the marginal edges 37, 38 of the plystock 39. It can be appreciated that the strip sensors 50, 51 are laterally positioned to reflect the desired overlap of the gum strips 59, 60 on the marginal edges 37, 38 of the plystock 39. The strip sensors 50, 51 are in electrical communication with any suitable guides which are located upstream of the strip sensors 50, 51, relative to the direction of travel of the gum strips 59, 60, to move a straying gum strip back to the desired pathway being monitored by the associated strip sensor.

In operation, a continuous piece of plystock 39 (FIG. 1) is removed from a letoff roll (not shown), passed over a roller conveyor 61 on the frame 11 leading to and from the support roll 46, threaded through the slots 35, 36 of the sensors 33, 34, and removed to a take-up roll (not shown) which is operated to pull the plystock 39 past the scriber 45 for marking. Gum strips 59, 60 are, likewise, removed from a letoff roll (not shown) and threaded through the guide slots 57, 58 of the associated strip sensors 50, 51 into overlapped relation on the marginal edges 37, 38 of the plystock 39 where stitcher rolls 62, 63 press the strips firmly against the plystock. The gum strips 59, 60 are each covered by a protective liner 64 which is removed immediately after contact of the strips with the plystock. The separated liners 64 are each wrapped on a takeup roll 65 which is driven to wind the liner thereon. Assuming the sensors 33, 34, 50, 51 are properly positioned to monitor movement of the plystock 39 and gum strips 59, 60, the scriber 45 is rotated into contact with the plystock 39 and the machine 10 started. Should the plystock 39 change in width or wander laterally from the initial pathway, the sensors 33, 34 will react to operate the necessary hydraulic cylinders 40, 42 to maintain the carriage 15 centrally below the plystock 39, so that the scribed mark on the plystock 39 will be, in fact, the centerline of the plystock. The strip sensors 50, 51 likewise react to cause movement of upstream guide rolls, e.g. rolls 66, 67, to adjust and correct the position of the strips, if required. Similar pricker rolls 68 are positioned downstream of the strip applicators to pierce any air pockets in which air becomes entrapped at the marginal edges of the piece during the application of the gum strips.

Thus, there is described a unique machine for monitoring a strip of material as it travels along a desired pathway, and adjusting the movement of the strip should it wander or stray from the pathway. The unique technology of the machine is used in marking the centerline of the strip. Further, the machine is employed to properly position gum strips on the marginal edges of the strip. It can be appreciated that the racks and carriage are mounted for limited movement sufficient to overcome alignment problems that are expected to normally occur during the course of marking the plystock. Any variance in width of the plystock is small enough, so that the initial location of the strip sensors, relative to the marginal edges of the plystock, needn't be changed during the marking process. The machine has proven to be extremely accurate in marking the centerline of the plystock.

What is claimed is:

1. A machine for monitoring the travel of a continuous piece of material used in the construction of a tire, comprising:

(a) a pair of horizontally spaced sensors when the machine is in operation for sensing opposing marginal edges of the piece of material;

(b) at least one support roll adjacent to the sensors for supporting the piece of material between the sensors as the piece of material travels past the sensors;

(c) means coacting with one of the sensors for simultaneously moving the sensors toward and away from each other when said one of the sensors senses lateral movement of the adjacent marginal edge of the piece of material relative thereto; and (d) means coacting with the other of the sensors for simultaneously moving the sensors and support roll in the same lateral direction relative to the direction of travel of the piece of material, when the other sensor similarly senses lateral movement of the adjacent marginal edge of the piece of material.

2. The machine of claim 1, wherein the sensors each have a horizontal slot through which an adjacent marginal edge of the piece of material passes, and the means (d) coacting with the other sensor includes, (I) a carriage for supporting the sensors and support roll, (II) means mounting the carriage for movement in a direction normal to the direction of travel of the piece of material past the sensors, and (III) means responsive to the other sensor for moving the carriage.

3. The machine of claim 2, wherein the means (c) coacting with the one sensor includes, (I) a pair of parallel horizontally disposed toothed racks to which the sensors are secured in confronting relation, (II) means mounting the racks for simultaneous horizontal movement including a rotatable pinion gear between the racks in toothed gear meshing relation, and (III) means responsive to the one sensor for horizontally moving one of the racks.

4. The machine of claim 3, wherein the support roll is adjacent the sensors and which includes, (I) a scriber centrally disposed above the support roll, (II) means mounting the support roll and scriber on the carriage for unitary lateral movement therewith, and (III) means mounting the scriber for movement to and from the support roll, the scriber designed to mark the centerline of the piece of material.

5. A machine for monitoring the travel of a continuous piece of unvulcanized rubbery material used in the construction of a tire, including marking the centerline of the piece, comprising:

(a) a stationery frame, when mounted on a horizontal surface, including a horizontal base portion with vertically extending end portions;

(b) a trackway disposed on the base portion of the frame between the end portions;

(c) a carriage movable aong the trackway, the carriage having at least one pair of wheels for rolling engaging the trackway;

(c) a drive screw extending through the carriage and the end portions of the frame in parallel relation with the trackway, to stabilize the carriage in a vertically upright position;

(e) means mounting the drive screw on the end portions of the frame for rotating and axial movement relative to the end portions;

(f) means mounting the drive screw on the carriage for independent rotation thereof and for unitary movement with the carrage along the trackway;

(g) a pair of sensors carried by the carriage in spaced horizontal aligned relation, the sensors having confronting slots for receiving opposing marginal edges of the piece of material;

(h) means mounting the sensors on the carriage for unitary movement towards and away from each other;

(i) means responsive to one of the sensors and coacting between the carriage and sensor mounting means (h) for simultaneously moving the sensors towards and away from each other, when the width of the piece of material varies from a norm to which the sensors are spaced;

(j) means responsive to one of the sensors and coacting between the frame and carriage for moving the carriage and sensors, in unison, along the trackway, when the piece of material wanders laterally from a fixed path to which the sensors are initially set to monitor;

(k) a support roll disposed adjacent to the carriage and adjacent to the sensors for rolling engagement with the piece of material as it travels past the sensors;

(l) means mounting the support roll for rotating around its longitudinal axis which is normal to the direction of travel of the piece of material past the sensors;

(m) means disposed centrally of the carriage and support roll in vertical relation above the roll for marking the centerline of the piece of material as it travels past the sensors; and (n) means mounting the marking means (m) for movement towards and away from the support roll.

6. The machine of claim 5 wherein the marking means (m) includes a rigid stylus, and the mounting means (n) of the marking means includes:

(p) a lever arm having one of a pair of opposing ends pivotally mounted on the carriage, (q) means for clamping the stylus to the other free end of the lever arm; and (r) means coupled between the carriage and lever arm for rotating the lever arm and attached stylus to and from the support roll.

7. The machine of claim 6, wherein the sensor mounting means (h) includes:

(s) a pair of toothed racks of vertically spaced, parallel planes;

(t) means mounting the racks for horizontal movement in said planes;

(u) a toothed pinion gear centrally positioned of the carriage and sensors between the racks in tooth meshing engagement with the racks; and the sensor moving means (i) includes:

(v) an actuating device coupled between the carriage and one of the racks.

* * * * *